United States Patent [19]

Mittelmann

[11] Patent Number: 4,693,345

[45] Date of Patent: Sep. 15, 1987

[54] RECTANGULAR PARALLELPIPED ARRANGEMENT OF TWO CASES FOR AIR TRAVEL

[75] Inventor: Gerhard Mittelmann, Oehningen, Fed. Rep. of Germany

[73] Assignee: Swiss Aluminium Ltd., Chippis, Switzerland

[21] Appl. No.: 887,268

[22] Filed: Jul. 21, 1986

[30] Foreign Application Priority Data

Jul. 25, 1985 [DE] Fed. Rep. of Germany ..... 3526577

[51] Int. Cl.[4] ..... B65D 21/02; A45G 5/12; A45G 5/14

[52] U.S. Cl. ..... 190/108; 206/279; 206/287; 206/288; 206/503; 190/18 A

[58] Field of Search ..... 190/108, 110, 102, 18 A; 206/287, 279, 288, 503

[56] References Cited

U.S. PATENT DOCUMENTS

| | | | |
|---|---|---|---|
| 930,032 | 8/1909 | Billburg et al. | 190/108 |
| 1,845,822 | 2/1932 | Wheary | 190/13 R |
| 2,428,906 | 10/1947 | Cannella | 190/108 X |
| 3,696,850 | 10/1972 | Rosenblum | 190/110 X |
| 3,974,898 | 8/1976 | Tullis et al. | 190/108 X |
| 4,303,184 | 12/1981 | Kloth | 190/110 X |
| 4,621,404 | 11/1986 | Browning | 190/102 X |
| 4,621,716 | 11/1986 | Rienacker | 190/108 |

*Primary Examiner*—William Price

*Attorney, Agent, or Firm*—Bachman and LaPointe

[57] ABSTRACT

A multi-compartment case, in particular such a case for air travel, features a rectangular parallelpiped shaped part with a handle on one narrow side and, projecting beyond the narrow side a tall part which is provided with a hinged lid on the front wall facing the other part and in its interior a device for hanging up clothes. The narrow side projects as a wall section out of a front wall of two tall case shells which are made mainly of light weight metal and are hinged together. The narrow side features connecting elements to secure a briefcase which, when joined to the case, makes the whole into a rectangular parallelpiped.

11 Claims, 8 Drawing Figures

RECTANGULAR PARALLELPIPED ARRANGEMENT OF TWO CASES FOR AIR TRAVEL

BACKGROUND OF THE INVENTION

The invention relates to a multi-compartment case, in particular such a case for air travel having a rectangular parallelpiped shaped part with a handle on one narrow side and, projecting beyond the narrow side, a tall part which features, on the front wall facing the other part of the case, a hinged lid and in its interior a device for hanging up clothes.

Cases of this kind having two interlocking, usually also identically shaped, shells that are joined together by hinges at one long side have been used by travellers for many years. To make transportation easier such cases are also often fitted with rolls or wheels at one edge, if desired also with a handle that can be pulled out in order to be able to move this case like a kind of trolley.

The disadvantage of such conventional cases especially to travellers on long journeys is in particular that suits have to be folded; shirts and the like are stacked in one of the half-size compartments. Because the shape of cases employed up to now meant that suits could only be packed folded and as a result lose their shape, a substitute has been created in the form of suit-bags in which the suits can be packed hanging as in a cupboard. However, because of their flexible covering such suit-bags have also not been able to prevent the clothing therein from becoming creased or the like.

When travelling, all businessmen take a briefcase with them. Suit-bag and briefcase are now almost standard cabin luggage of airline passengers who, in addition, usually have a case in the cargo compartment and often a collapsable trolley. It can be readily seen how awkward it is both for the traveller and for the transportation firm e.g. the airline company, to move luggage. The increasing profusion of luggage, which sometimes has to be packed into a freight container at only short notice, presents considerable problems for the airline company.

In view of the above it is the object of the present invention to develop a new concept for luggage thanks to which well arranged transportation of travellers requisites is possible at the same time with easier handling of the items of luggage. Further it should be possible to manufacture the case of the kind mentioned at the start without problem and to transport the same in the aircraft without use of a container.

SUMMARY OF THE INVENTION

The foregoing object is achieved by way of the present invention wherein the narrow side projects as a wall section out of a front wall of two tall case shells which are made mainly of light weight metal and are hinged together, and features connecting elements to secure a briefcase which, when joined to the case, makes the whole into a rectangular parallelpiped.

According to an advantageous development of the invention undercut grooves run along the surface of the wall section, into which grooves can be fitted rail sections of corresponding shape fitted to the base of the briefcase or the like; the said rail sections are preferably hook-shaped in cross-section and can be manufactured in one piece, along with the base of the briefcase, out of extruded aluminum. Usefully, the grooves run parallel to the front wall of the case shell so that the briefcase or the like can be pushed in sideways with a relatively long sliding action. If necessary the briefcase can be attached securely to the case by means of additional locking elements.

In order to make the case easier to carry after the briefcase has been removed, a tilt up handle of conventional design is provided in the surface of the wall section; when carrying the case by this handle, the part of the case above the wall section can then be held firmly under the armpit by the upper arm. A further such handle for carrying the case is provided in the region of the top strip or top wall of the part of the case that projects upwards; the case can be held by this handle especially if it is to be transported on its rollers. It is namely within the scope of the invention for the case to have on a side, close to the ground, rollers which offer sufficient stability to the case while being transported thereon—in contrast to conventional narrow case wheels which often tend to tilt over.

Further, the wall section can be made of an extruded lightweight metal section or the same in combination with the neighbouring front wall, which above all ensures a high degree of stability to the joint between the case and the briefcase.

While the space between the tall case shells is intended mainly for suits, shirts or the like, the step-like offset space is intended for underwear and shoes, for which purpose drawer-like compartments that are accessable from outside are provided in the said offset space, preferably between longitudinal alignment ribs.

Although the drawer compartments should preferably be slid parallel to the neighbouring front wall, it is also within the scope of the invention to provide the outer wall of the case with a flap and to insert the drawer compartments perpendicular to the front wall.

The case also features special elements for packing suits and shirts viz., in the region of the top strips or top wall at least one alignment element into which a correspondingly shaped part of a special coat hanger for the case is inserted; the alignment element is in the form of an undercut groove into which a specially shaped knob on the coat hanger can be fitted. The alignment element is preferably manufactured by means of extrusion, in one piece together with the case shell and, if desired, together with special subdividing walls of the case shell.

It has been found favourable to form the alignment element out of two facing, hook-shaped strips which form an undercut groove; preferably a T-shaped extension of the coat hanger rests in this groove.

Independent protection is sought for the combination of the described alignment element in the case on the one hand and the specially shaped coat hanger on the other hand; the latter is made out of a flat plastic or lightweight metal sheet and is such that the body of the coat hanger is preferably delimited by two isosceles triangles on the same common base. These triangles determine the contour of the coat hanger with, at one end of its shorter middle axis, a T-shaped extension and, at the other end of that axis, a conventional coat hanger hook so that the coat hanger can be used both in the case and on conventional rails in wardrobes. For these different situations it simply requires the clothing to be removed and then suspended again on the inverted coat hanger. Normal suit jackets fit well and without problem onto the parts of the coat hanger sloping down on both sides of the T-shaped part or hook; the suit trousers can be hung up in a slit of appropriate width running transversely across the short middle axis of the body of the coat hanger.

The case according to the invention is opened with the tall sides upright so that the clothes are presented to the user as in a wardrobe. Additional bags for shoes can be hung up in the tall part of the case so that the sliding, drawerlike compartments in the offset part of the case can be used exclusively for underwear and small items. Thanks to the concept of the case according to the invention the unpacking of the suitcase in the hotel is eliminated and with that also the well known irritation experienced by travellers due to too small space for storing cases and the usual, ungratifying experience of living out of a suitcase on the floor of the hotel room.

The case according to the invention provides a solution to another problem. The widely different shapes of conventional luggage have up to now prevented any solution to efficient luggage storage. This has prevented optimum use of storage space and reduction of the weight load, especially with airlines. The step-shape of the case according to the invention permits optimum stacking inside an aircraft container or—much more important—also on palettes. The close fitting together of the cases can, thanks to their standard shape, also be stacked on palettes by the passengers. The close fitting of the cases also means that dead space is avoided.

The result is a case which is particularly favourable both for the traveller and for the transportation company. Its standard briefcase part also takes into account the increasing wish in future to permit only standard cabin luggage—this as a precaution against attacks on board aircraft.

BRIEF DESCRIPTION OF THE DRAWINGS

Further advantages, features and details of the present invention are revealed in the following description of preferred exemplified embodiments and with the aid of the schematic drawings wherein.

DETAILED DESCRIPTION

Figures 1, 2, 3, 4:
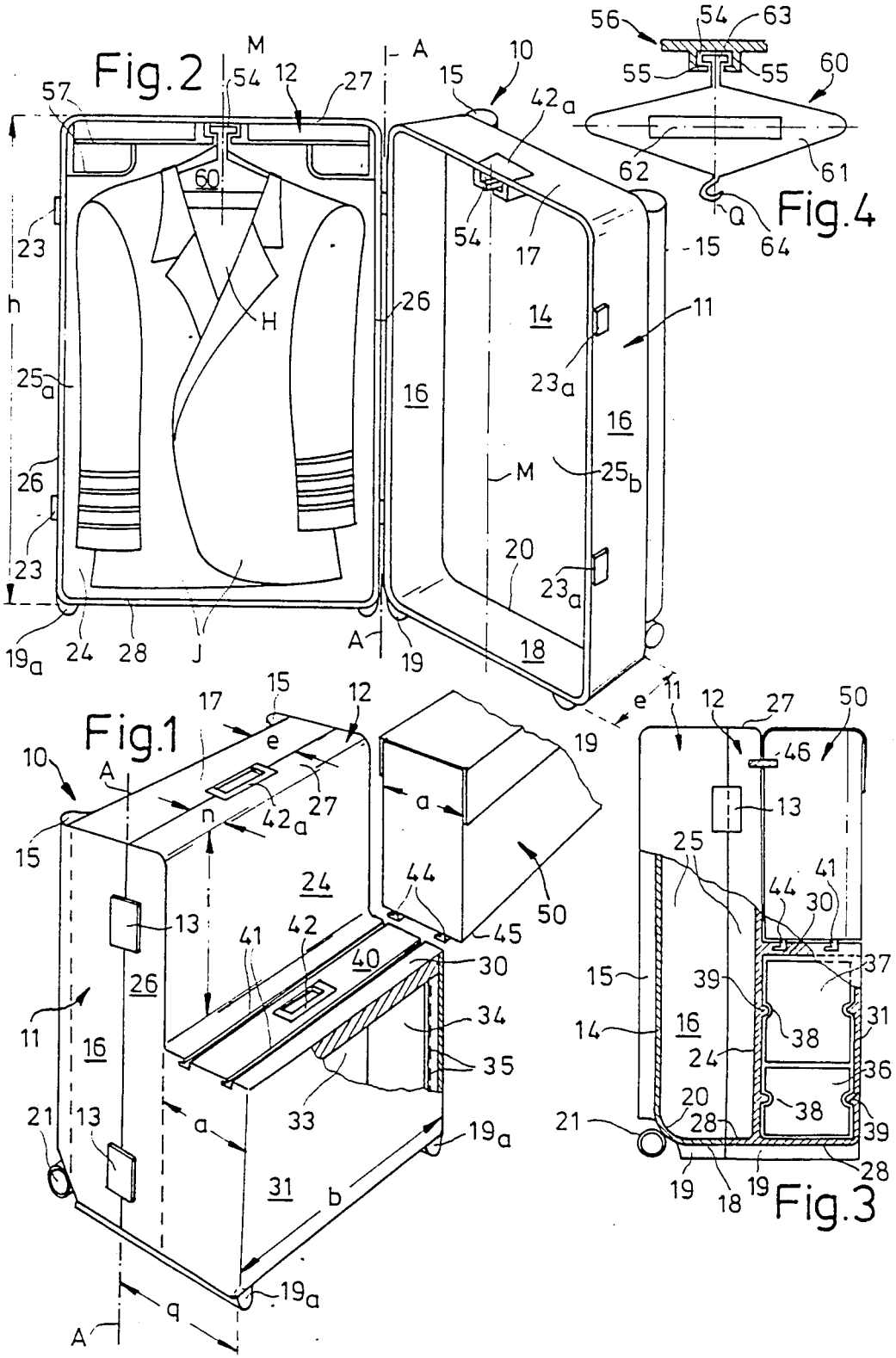
FIG. 1: A perspective view of a case.
FIG. 2: The case in FIG. 1, shown open here.
FIG. 3: A partly sectioned end view of the closed case.
FIG. 4: A detail from the case in the form of an appropriately designed coat hanger.

A case 10 for airline passengers, for example such a case of height h of 750 mm and breadth b of 420 mm, comprises two hard case shells 11,12 of different shape hinged together along a hinge axis A.

One of the case shells 11 features a front wall 14, two sidewalls 16, a top strip 17 and a bottom strip 18—both of the same width e, for example 150 mm. The front wall 14 and the bottom strip 18 both feature runners 15 and 19 in the form of strips that lie along the edges formed with the sidewalls 16. Mounted at edge 10 formed by the bottom strip 18 and the front wall 14 are rollers 21 which can rotate; these are mounted for example as in FIG. 6 on axles 22 the end of which are supported by the runners 15 on the front wall 14.

The front wall 24 of the other case shell 12 is also surrounded by sidewalls 26, a top wall 27 and a base 28 featuring runners **19*a*. The width n of the top wall 27 and the parts of the sidewalls 26 are little more than 100 mm. Hinges 13 are provided on axis A of the, when the case 10 is open as in FIG. 2, neighbouring sidewalls 16,26 of case shells 11,12; lock parts 23,23*a* are fitted to each of the other parts of sidewalls 16,26**.

Parallel to the top wall 27 and projecting out from the front wall 24 a distance i of 375 mm is a wall section 30, the width a, about 200 mm, of which the sidewalls 26 are extended in a stepped manner at the wall section 30 and run with this width q (a+n) down to the base 28 of the case 10. The base 28 together with the sidewalls 26, wall section 30 and an outer wall 31 forms a special compartment 33 which is accessable via a flap 34 in one of the sidewalls; flap hinges are indicated by 35.

As shown in FIG. 3 compartment 33 houses a box section 36 for shoes and another box section 37 for laundry items—each part 36,37 featuring pairs of alignment grooves 38. Longitudinal ribs 39 project into and engage on these alignment grooves 38.

To be seen particularly well in FIG. 1 are undercut longitudinal grooves 41 in surface 40 of the wall section 30. Between these grooves 41 is a handle 42 which can be tilted up; such a handle **42*a* is also provided in the top strip 17 and top wall 27**.

Sections 44, which are shaped like one-sided hooks in FIGS. 1 and 3, correspond in cross-sectional shape to the longitudinal grooves 41 in wall section 30 into which the said retaining sections 44 can be pushed. These retaining sections 44 project out from the base 45 of a piece of hand luggage or briefcase 50 which is additionally secured by locking means 46 to the case 10 which then becomes a rectangular piece of luggage 10/15 which is easy to transport.

Without briefcase 50 the case 10 can be held for example by handle 42 in surface 40 so that the, in FIG. 1, upward projecting part of the case rests under the armpit allowing additional means of gripping the case while it is being carried.

Figure 7:
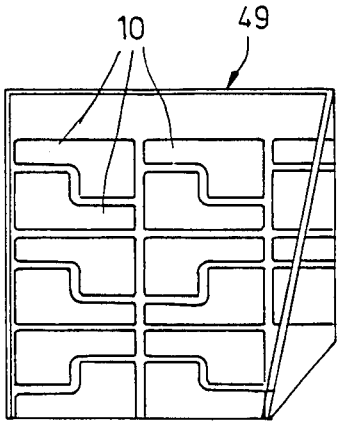
FIG. 7: A longitudinal section through an aircraft luggage container.
Figure 8:
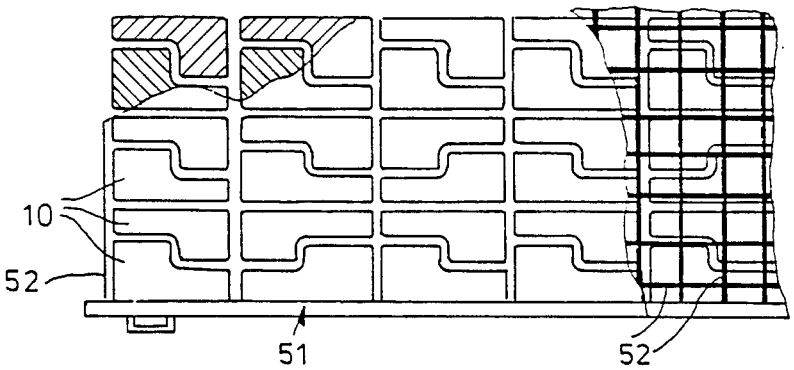
FIG. 8: An end view of a plurality of cases on a loading palette, shown only in part here.

A further advantage of this case 10 is revealed in FIGS. 7 and 8 viz., that its step shape enables the case to be neatly and very easily stacked in a freight container 49 or on a palette, also by the passenger himself. The thus stacked cases 10 help to secure each other in place and can be secured as a whole on the palette 51 by means of a net 52.

The design of the hanging space 25 in the case 10 (FIG. 3) has been chosen such that at least in one of the two compartments **25*a*, 25*b* suit jackets J, shirts or the like can be hung up as in a cupboard—there is no folding together for the journey! In order to reduce the necessary height h, top strip 17 and/or top wall 27 are/is provided on the inside, approximately at the central axis M of the front wall 14 or 24, with an undercut groove 54 which for example is formed by a section 55 which is hook-shaped in cross-section; these sections 55 are formed together with a frame section 56 of case shells 11,12 in one piece out of light weight metal via extrusion, if desired together with strips 57**.

Likewise out of light weight metal, or out of hard plastic, are coat hangers 60 as in FIG. 4 with leaf-shaped body 61 that forms on both sides of a central axis Q preferably an isosceles triangle and features at its middle axis a slit 62 to accommodate the legs of folded trousers H. This clothes hanger 60 features at one end of its vertical axis Q a T-shaped strut 63 the head of which can be pushed into the undercut groove 54. At the other end of the vertical axis Q is a hook 64 such as is found with conventional coat-hangers to hang upon a coat or clothes rail; this multi-way coat hanger can therefore be used in the conventional manner and in the described case 10.

Figure 5:
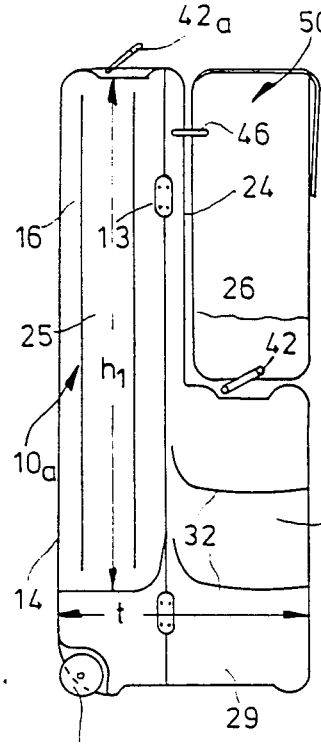
FIG. 5: A side view of another version of the case.
Figure 6:
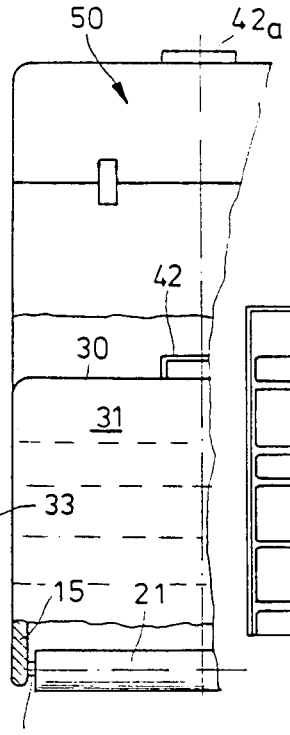
FIG. 6: A part of the front elevation of the case in FIG. 5.

The version of the case 10*a* shown in FIGS. 5 and 6 features, below the hanging space 25, a space 29 for shoes which extends over the whole depth t (e.g. 350 mm) of the case. Here too the sidewalls 16,26 and the case shells 11,12 are of different depth e. Above the shoe compartment 29 are rigid floors 32 dividing up space 33.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A multi-compartment travel case comprising a first clothes hanging compartment defined by first and second case shells hinged together along a hinge axis A, said first and second case shells each having a front wall, a pair of substantially parallel side walls and substantially parallel top and bottom strips; a second storage compartment defined by a top wall section, sidewalls and a bottom wall section projecting out from said front wall of said first case shell in a stepped like manner so as to form a substantially L-shaped configuration, said top wall section being provided with means for securing a storage case thereto; and a third storage compartment having a bottom wall provided with attachment means for attaching said third storage compartment to said securing means on said top wall section of said second storage compartment so as to form a rectangular parallelpiped.

2. A case according to claim 1 wherein said securing means comprises hook-shaped undercut grooves.

3. A case according to claim 2 wherein locking elements are provided on said front wall and said third storage compartment.

4. A case according to claim 1 wherein said clothes hanging compartment is provided with a handle in the region of the top strips of the first and second shells.

5. A case according too claim 1 wherein said second storage compartment is provided with a handle on said top wall section.

6. A case according to claim 1 wherein said second storage compartment is provided with a push-in flap for making said compartment accessible from outside.

7. A case according to claim 1 wherein an alignment element for receiving a counterpart on a coat hanger is made in one piece with the top strips of the case shells.

8. A case according to claim 7 wherein the alignment element is a groove formed by two facing, hook-shaped strips into which groove a T-shaped extension of the coat hanger is introduced, and the coat hanger is made from a flat body with short middle axis passing through the T-shaped extension and a conventional hook at the other end of that middle axis.

9. A case according to claim 8 wherein each outer edge of the flat body on both sides of the middle axis of the coat hanger is in the form of an isosceles triangle and the free ends of the same sides come together at the extension and the hook.

10. A case according to claim 1 wherein at least one of the bottom strips of the case shells is provided with runners to help the case stand upright, and the case shell with said runners projecting out from it compliments the case shell with the second storage compartment and features along one edge region between the front wall and the bottom strip at least one conventional roller on which the case can be rolled.

11. A case according to claim 1 wherein said second storage compartment is releasably joined to said front wall by provision of an intermediate wall.

* * * * *